US008983347B2

(12) United States Patent
Kuroda et al.

(10) Patent No.: US 8,983,347 B2
(45) Date of Patent: Mar. 17, 2015

(54) DEVELOPING ROLLER

(71) Applicant: Sumitomo Rubber Industries, Ltd., Kobe-shi, Hyogo (JP)

(72) Inventors: Kenichi Kuroda, Kobe (JP); Akihiko Kawatani, Kobe (JP); Takashi Marui, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 109 days.

(21) Appl. No.: 13/920,919

(22) Filed: Jun. 18, 2013

(65) Prior Publication Data

US 2014/0023411 A1 Jan. 23, 2014

(30) Foreign Application Priority Data

Jul. 19, 2012 (JP) ..... 2012-160796

(51) Int. Cl.
*G03G 15/08* (2006.01)

(52) U.S. Cl.
CPC ..... *G03G 15/0818* (2013.01)
USPC ..... 399/286

(58) Field of Classification Search
USPC ..... 399/130, 286
See application file for complete search history.

(56) References Cited

U.S. PATENT DOCUMENTS

| | | | | |
|---|---|---|---|---|
| 2008/0175630 | A1 | 7/2008 | Yasunaga et al. | |
| 2008/0292366 | A1* | 11/2008 | Akama et al. | 399/286 |
| 2011/0229202 | A1* | 9/2011 | Mizumoto et al. | 399/130 |

FOREIGN PATENT DOCUMENTS

| | | | |
|---|---|---|---|
| JP | 8-262866 | A | 10/1996 |
| JP | 2006-145956 | A | 6/2006 |
| JP | 2008-076945 | A | 4/2008 |
| JP | 2008-134428 | A | 6/2008 |
| JP | 2008-180890 | A | 8/2008 |
| JP | 2011-154122 | A | 8/2011 |
| JP | 2012-22193 | A | 2/2012 |

* cited by examiner

*Primary Examiner* — Hoang Ngo
(74) *Attorney, Agent, or Firm* — Birch, Stewart, Kolasch & Birch, LLP

(57) ABSTRACT

A developing roller is provided which is capable of forming a toner layer having the most uniform possible thickness on an outer peripheral surface of a roller body thereof. The roller body (2) of the developing roller (1) is formed from a rubber composition comprising: a base rubber which is a mixture comprising NBR and/or SBR, CR and an epichlorohydrin rubber; and not less than 2.5 parts by mass and not greater than 15 parts by mass of a tackiness imparting agent based on 100 parts by mass of the base rubber.

5 Claims, 1 Drawing Sheet

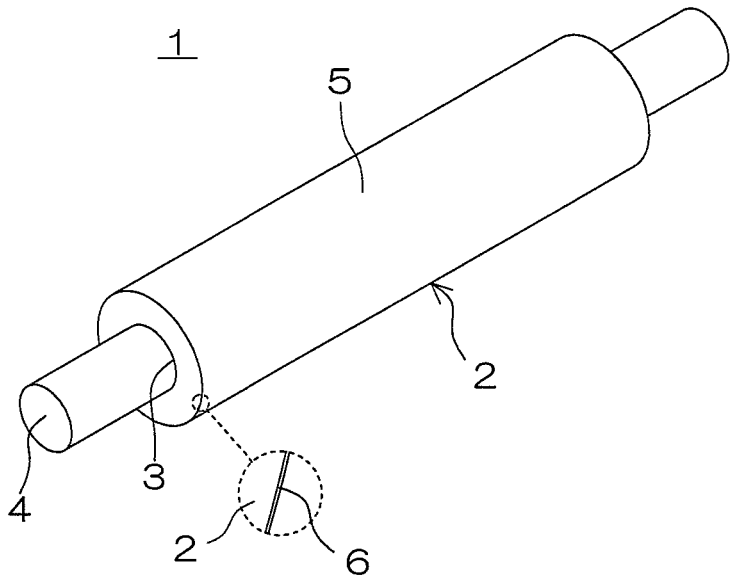
1
5
2
4
3
2
6

DEVELOPING ROLLER

TECHNICAL FIELD

The present invention relates to a developing roller to be incorporated in a developing section of an electrophotographic image forming apparatus such as a laser printer.

BACKGROUND ART

In an electrophotographic image forming apparatus such as a laser printer, an electrostatic copying machine, a plain paper facsimile machine or a printer-copier-facsimile multifunction machine, a developing roller and a quantity regulating blade (charging blade) kept in press contact with an outer peripheral surface of a roller body of the developing roller are used for developing an electrostatic latent image formed by exposing an electrically charged surface of a photoreceptor drum into a toner image.

That is, when the developing roller is rotated with the quantity regulating blade in press contact with the developing roller, toner is electrically charged. The electrically charged toner is caused to adhere onto the outer peripheral surface of the developing roller, while the amount of the adhering toner is regulated by the quantity regulating blade. Thus, a toner layer is formed on the outer peripheral surface of the developing roller as having a generally constant thickness.

When the developing roller is further rotated in this state to transport the toner layer to the vicinity of the surface of the photoreceptor drum, the toner of the toner layer is selectively transferred from the toner layer onto the drum surface according to the electrostatic latent image formed on the surface of the photoreceptor drum. Thus, the electrostatic latent image is developed into the toner image.

The developing roller is generally produced in the following manner. A rubber composition is formed into a tubular shape and crosslinked to produce a roller body. Then, a shaft made of a metal or the like is inserted through a center through-hole of the roller body to be electrically connected and mechanically fixed to the roller body. Further, an outer peripheral surface of the roller body is polished as required.

For preparation of the rubber composition, a base rubber containing, for example, at least a copolymer rubber (ion conductive rubber) including ethylene oxide as a comonomer and having ion conductivity is prepared, and additives such as a crosslinking agent and an accelerating agent for crosslinking the base rubber are blended with the base rubber.

The developing roller is required to prevent imaging failures such as a so-called fogging phenomenon in which the toner adheres to a background portion of the formed image, and inconsistent image density of the formed image.

To satisfy the requirement, it is contemplated, for example, in Patent Literature 1 to control an average inter-peak distance Sm at 10 to 300 μm to define the surface roughness of the outer peripheral surface of the roller body, and to control the microscopic rubber hardness A of the roller body at 20 to 80.

Further, it is contemplated in Patent Literature 2 to control a center line average roughness Ra at not greater than 0.3 μm to define the surface roughness of the outer peripheral surface of the roller body, and to control the positional relationship between the quantity regulating blade and the developing roller in a predetermined range.

In Patent Literature 3, it is contemplated to control the center line average roughness Ra, the ten-point average roughness Rz and the roughness curve element average length Rsm of the outer peripheral surface of the roller body with respect to the volume average particle diameter of the toner to satisfy a predetermined relationship.

In Patent Literature 4, it is contemplated to coat the outer peripheral surface of the roller body with a coating layer containing particles of at least an acrylic resin and a fluororesin.

CITATION LIST

Patent Literature

Patent Literature 1: JP-2006-145956A
Patent Literature 2: JP-2008-134428A
Patent Literature 3: JP-2008-180890A
Patent Literature 4: JP-2008-76945A

SUMMARY OF THE INVENTION

Problem to be Solved by the Invention

According to studies conducted by the inventors of the present invention, it is impossible to sufficiently reduce the variations in toner triboelectric chargeability and toner transporting ability to allow the toner layer to have a uniform thickness simply by controlling the center line average roughness Ra and other factors of the outer peripheral surface of the roller body to define the surface geometry of the roller body as described in Patent Literatures 1 to 3.

Unless a relationship between the roughness of the outer peripheral surface as measured in a circumferential direction and the roughness of the outer peripheral surface as measured in a widthwise direction is precisely controlled according to the average particle diameter of the toner to be used in combination with the developing roller, it is impossible to reduce the variations in toner triboelectric chargeability and toner transporting ability to allow the toner layer to have a uniform thickness.

However, it is practically impossible to precisely control the surface geometry of the outer peripheral surface of the roller body in the different directions according to the average particle diameter of the toner by an ordinary polishing process and the like.

Further, the formation of the coating layer on the outer peripheral surface of the roller body as described in Patent Literature 4 is liable to suffer from contamination with dust and the like during a period from the preparation of a coating agent to the application and the drying of the coating agent, thereby making the thickness and the surface geometry of the coating layer less uniform. Even without the contamination with the dust and the like, the coating layer is liable to have an uneven thickness to adversely increase the variations in toner triboelectric chargeability and toner transporting ability, so that the toner layer has an uneven thickness.

It is an object of the present invention to provide a developing roller which is capable of forming a toner layer having the most uniform possible thickness on an outer peripheral surface of a roller body thereof with reduced variations in toner triboelectric chargeability and toner transporting ability as compared with the prior art.

Solution to the Problem

The present invention provides a developing roller to be use in an electrophotographic image forming apparatus, the developing roller comprising a roller body formed from a rubber composition, wherein the rubber composition comprises:

a base rubber; and not less than 2.5 parts by mass and not greater than 15 parts by mass of a tackiness imparting agent based on 100 parts by mass of the base rubber, wherein the base rubber is a mixture comprising:

at least one selected from the group consisting of an acrylonitrile butadiene rubber and a styrene butadiene rubber;

a chloroprene rubber; and an epichlorohydrin rubber.

According to the present invention, the predetermined amount of the tackiness imparting agent (tackifier) is blended in the rubber composition, whereby substantially the entire outer peripheral surface of the roller body is uniformly imparted with a proper adhesive force with respect to the toner.

Therefore, the variations in toner triboelectric chargeability and toner transporting ability of the outer peripheral surface can be reduced as much as possible over substantially the entire outer peripheral surface irrespective of the surface geometry of the outer peripheral surface. As a result, the toner layer adhering to the developing roller can have a uniform thickness, so that the developing roller is substantially free from imaging failures such as the fogging phenomenon and the inconsistent image density which may otherwise occur when the toner layer has an uneven thickness.

The roller body is formed from the rubber composition in a single layer structure, and has an oxide film formed in the outer peripheral surface thereof by irradiation with ultraviolet radiation having a wavelength of not less than 100 nm and not greater than 400 nm.

The single layer developing roller has a simplified structure as a whole. By the irradiation with the ultraviolet radiation at the specific wavelength, the oxide film can be formed in the outer peripheral surface of the roller body as having a very small thickness for finely controlling the adhesive force of the outer peripheral surface with respect to the toner.

The oxide film is formed through oxidation of the rubber composition forming the outer peripheral surface of the roller body by the irradiation with the ultraviolet radiation and, therefore, is highly uniform in thickness and surface geometry without the problem associated with the provision of the coating layer formed by applying the coating agent in the prior art.

With the provision of the oxide film, it is possible to finely control the adhesive force of the outer peripheral surface with respect to the toner to finely control the thickness of the toner layer, the image density of the formed image and the like without impairing the uniformity of the thickness of the toner layer formed on the outer peripheral surface of the roller body.

The outer peripheral surface of the roller body preferably has an adhesive force that is controlled at not less than 18 nN and not greater than 40 nN with respect to the toner for use in the image forming apparatus by blending the tackiness imparting agent or by forming the oxide film in the outer peripheral surface.

With the adhesive force controlled at not less than 18 nN, the variations in toner triboelectric chargeability and toner transporting ability are further reduced to allow the toner layer to have a more uniform thickness. This further suppresses imaging failures such as the fogging phenomenon and the inconsistent image density which may otherwise occur when the toner layer has an uneven thickness.

If the adhesive force is greater than 40 nN, the toner adhering to the outer peripheral surface is not easily transferred from the outer peripheral surface to the surface of the photoreceptor drum, whereby the formed image is liable to have a reduced image density. Further, frictional forces occurring between the outer peripheral surface of the roller body and seal members are liable to be increased. Therefore, portions of the outer peripheral surface kept in contact with the seal members are worn by repeated image formation, for example, when about 8000 images are formed. This may result in formation of gaps between the outer peripheral surface and the seal members, thereby causing leakage of the toner.

Effects of the Invention

According to the present invention, the variations in toner triboelectric chargeability and toner transporting ability are reduced as compared with the prior art, so that the toner layer can be formed on the outer peripheral surface of the roller body as having the most uniform possible thickness. Thus, the developing roller is less liable to suffer from imaging failures such as the fogging phenomenon and the inconsistent image density which may otherwise occur when the toner layer has an uneven thickness.

BRIEF DESCRIPTION OF THE DRAWING

FIG. 1 is a perspective view illustrating an exemplary developing roller according to an embodiment of the present invention.

EMBODIMENTS OF THE INVENTION

The present invention provides a developing roller to be use in an electrophotographic image forming apparatus. The developing roller includes a roller body formed from a rubber composition containing a base rubber. The base rubber is a mixture containing: at least one selected from the group consisting of an acrylonitrile butadiene rubber and a styrene butadiene rubber; a chloroprene rubber; and an epichlorohydrin rubber. The rubber composition further contains not less than 2.5 parts by mass and not greater than 15 parts by mass of a tackiness imparting agent based on 100 parts by mass of the base rubber.

<Tackiness Imparting Agent>

Any of various tackiness imparting agents which are highly compatible with the base rubber and function to impart the roller body with a proper adhesive force with respect to a toner are usable as the tackiness imparting agent.

Examples of the tackiness imparting agent include rosin tackiness imparting agents such as a rosin ester and a terpene phenol resin derived from rosin, alkyl phenol resins, and aliphatic hydrocarbon resins and alicyclic hydrocarbon resins prepared by employing 1,3-pentadiene, cyclopentadiene or the like extracted from a petroleum distillate as a major raw material. These tackiness imparting agents are used either alone or in combination.

Particularly, the rosin ester is preferred. Preferred examples of the rosin ester include rosin esters available under the trade name of SUPER ESTER SERIES A-75 (having an acid value of not greater than 10 and a softening point of 70° C. to 80° C. (as measured by the ring and ball method)) and A-100 (having an acid value of not greater than 10 and a softening point of 95° C. to 105° C. (as measured by the ring and ball method)) from Arakawa Chemical Industries Ltd.

The proportion of the tackiness imparting agent to be blended is limited to a range of not less than 2.5 parts by mass and not greater than 15 parts by mass based on 100 parts by mass of the base rubber. This is based on the following consideration:

If the proportion of the tackiness imparting agent is less than the aforementioned range, the outer peripheral surface of the roller body has an insufficient adhesive force with respect to the toner, making it impossible to provide the effect of reducing the variations in toner triboelectric chargeability and toner transporting ability to allow the toner layer to have a uniform thickness. Therefore, imaging failures such as the fogging phenomenon and the inconsistent image density cannot be prevented, which may otherwise occur when the toner layer has an uneven thickness.

If the proportion of the tackiness imparting agent is greater than the aforementioned range, on the other hand, the outer peripheral surface of the roller body has an excessively great adhesive force with respect to the toner, so that the toner adhering to the outer peripheral surface is not easily transferred from the outer peripheral surface to the surface of the photoreceptor drum. Therefore, the formed image is liable to have a reduced image density. In general, opposite end portions of the outer peripheral surface of the roller body of the developing roller are kept in contact with seal members for prevention of leakage of the toner. If the proportion of the tackiness imparting agent is greater than the aforementioned range, frictional forces occurring between the outer peripheral surface and the seal members are liable to be increased. Therefore, portions of the outer peripheral surface kept in contact with the seal members are worn by repeated image formation, for example, when about 8000 images are formed. This may result in formation of gaps between the outer peripheral surface and the seal members, thereby causing the toner leakage.

Where the proportion of the tackiness imparting agent is within the aforementioned range, in contrast, it is possible to allow the toner layer to have a uniform thickness while preventing the toner leakage and the reduction in the image density of the formed image. Further, the adhesive force of the outer peripheral surface of the roller body with respect to the toner can be controlled by controlling the proportion of the tackiness imparting agent within the aforementioned range.

In order to allow the toner Layer to have a further uniform thickness while preventing the tuner leakage and the reduction in the image density of the formed image as much as possible, the proportion of the tackiness imparting agent is preferably not less than 5 parts by mass and not greater than 10 parts by mass based on 100 parts by mass of the base rubber.

Where a single type of tackiness imparting agent is used, the proportion of the tackiness imparting agent is defined as the proportion of the single type of tackiness imparting agent. Where two or more types of tackiness imparting agents are used, the proportion of the tackiness imparting agent is defined as the total proportion of the two or more types of tackiness imparting agents.

<Base Rubber>

A mixture containing at least one selected from the group consisting of an acrylonitrile butadiene rubber (NBR) and a styrene butadiene rubber (SBR), a chloroprene rubber (CR), and an epichlorohydrin rubber is used as the base rubber.

Among these rubbers, the epichlorohydrin rubber is an ion conductive rubber, which imparts the roller body with ion conductivity to control the roller resistance of the developing roller within a proper roller resistance range. Thus, the epichlorohydrin rubber functions to triboelectrically charge the toner to a proper charge level in a developing step.

That is, it is possible to electrically charge the toner to a charge level suitable for developing an electrostatic latent image on the surface of the photoreceptor drum when the developing roller is rotated with the quantity regulating blade kept in press contact with the roller body thereof.

The CR and the NBR are polar rubbers, and function to finely control the roller resistance of the developing roller.

Further, the SBR and the NBR function to reduce the hardness of the roller body to improve the flexibility of the roller body, and to reduce the compression set of the roller body to prevent the permanent compressive deformation of the roller body.

The CR, the SBR and the NBR also function as a material for forming an oxide film in the outer peripheral surface of the roller body through oxidation by irradiation with ultraviolet radiation.

(Epichlorohydrin Rubber)

Examples of the epichlorohydrin rubber include epichlorohydrin homopolymer rubbers, epichlorohydrin-ethylene oxide bipolymer rubbers (ECO), epichlorohydrin-propylene oxide bipolymer rubbers, epichlorohydrin-ethylene oxide-allyl glycidyl ether terpolymer rubbers (GECO), epichlorohydrin-propylene oxide-allyl glycidyl ether terpolymer rubbers and epichlorohydrin-ethylene oxide-propylene oxide-allyl glycidyl ether quaterpolymer rubbers, which may be used either alone or in combination.

Particularly, the ethylene oxide-containing copolymer rubbers are preferred. The ethylene oxide-containing copolymer rubbers preferably each have an ethylene oxide content of not less than 30 mol % and not greater than 95 mol %, more preferably not less than 55 mol %, particularly preferably not less than 60 mol % and not greater than 80 mol %.

Ethylene oxide functions to impart the roller body with ion conductivity through stabilization of a great amount of ions to reduce the roller resistance of the developing roller to a roller resistance range suitable for the developing roller. If the ethylene oxide content is less than the aforementioned range, however, it will be impossible to sufficiently provide this function and hence to sufficiently reduce the roller resistance of the developing roller.

If the ethylene oxide content is greater than the aforementioned range, on the other hand, ethylene oxide is liable to be crystallized, whereby the segment motion of molecular chains is hindered. This may adversely increase the roller resistance of the developing roller and the hardness of the roller body. This may further increase the viscosity of the rubber composition before the crosslinking, thereby reducing the formability of the rubber composition.

Particularly, epichlorohydrin-ethylene oxide bipolymers (ECO) are preferred as the ethylene oxide-containing copolymer rubbers.

The ECO preferably has an ethylene oxide content of not less than 30 mol % and not greater than 80 mol %, particularly preferably not less than 50 mol %, and an epichlorohydrin content of not less than 20 mol % and not greater than 70 mol %, particularly preferably not greater than 50 mol %.

Epichlorohydrin-ethylene oxide-allyl glycidyl ether terpolymers (GECO) are also usable as the copolymer rubber.

The GECO preferably has an ethylene oxide content of not less than 30 mol % and not greater than 95 mol %, particularly preferably not less than 60 mol % and not greater than 80 mol %, an epichlorohydrin content of not less than 4.5 mol % and not greater than 65 mol %, particularly preferably not less than not less than 15 mol % and not greater than 40 mol %, and an allyl glycidyl ether content of not less than 0.5 mol % and not greater than 10 mol %, particularly preferably not less than 2 mol % and not greater than 6 mol %.

Ally glycidyl ether per se functions as side chains of the copolymer to provide a free volume, whereby the crystallization of ethylene oxide is suppressed to reduce the roller resistance of the developing roller. If the allyl glycidyl ether content is less than the aforementioned range, however, it will be impossible to provide the function and hence to sufficiently reduce the roller resistance of the developing roller.

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered to adversely increase the roller resistance of the developing roller. Further, the developing roller is liable to suffer from reduction in tensile strength, fatigue resistance and flexural resistance.

The GECO has an epichlorohydrin content that is a balance obtained by subtracting the ethylene oxide content and the allyl glycidyl ether content from the total. That is, the epichlorohydrin content is preferably not less than 4.5 mol % and not greater than 69.5 mol %, particularly preferably not less than 14 mol % and not greater than 38 mol %.

Examples of the GECO include terpolymer rubbers obtained by copolymerizing the three comonomers described above in a narrow sense, as well as known modification products obtained by modifying an ECO with allyl glycidyl ether. In the present invention, any of these modification products are usable as the GECO.

The proportion of the epichlorohydrin rubber to be blended is preferably not less than 20 parts by mass and not greater than 60 parts by mass, particularly preferably not less than 30 parts by mass and not greater than 50 parts by mass, based on 100 parts by mass of the base rubber.

If the proportion of the epichlorohydrin rubber is less than the aforementioned range, it will be impossible to provide the effect of imparting the roller body with sufficient ion conductivity and controlling the roller resistance of the developing roller in the proper range. That is, it will be impossible to sufficiently reduce the roller resistance, thereby excessively reducing the image density of the formed image.

If the proportion of the epichlorohydrin rubber is greater than the aforementioned range, on the other hand, the roller resistance is liable to be adversely reduced, thereby excessively increasing the image density of the formed image.

Where a single type of epichlorohydrin rubber is used, the proportion of the epichlorohydrin rubber is defined as the proportion of the single type of epichlorohydrin rubber. Where two or more types of epichlorohydrin rubbers are used, the proportion of the epichlorohydrin rubber is defined as the total proportion of the two or more types of epichlorohydrin rubbers.

(NBR, SBR)

The NBR is a rubber of a copolymer of acrylonitrile and butadiene, and may be any of lower-acrylonitrile-content NBRs having an acrylonitrile content of not greater than 24%, an intermediate-acrylonitrile-content NBRs having an acrylonitrile content of 25 to 30%, intermediate- and higher-acrylonitrile-content NBRs having an acrylonitrile content of 31 to 35%, higher-acrylonitrile-content NBRs having an acrylonitrile content of 36 to 42%, and very-high-acrylonitrile-content NBRs having an acrylonitrile content of not less than 43%. Particularly, use of a lower-acrylonitrile-content NBR having a lower specific gravity reduces the specific gravity of the developing roller for weight reduction.

These NBRs may be used either alone or in combination.

Usable as the SBR are various SBRs synthesized by copolymerizing styrene and 1,3-butadiene by an emulsion polymerization method, a solution polymerization method, and the like. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable. Physical properties of the roller body can be controlled by changing the styrene content and the crosslinking degree.

These SBRs may be used either alone or in combination.

The proportion of the NBR and/or the SBR to be blended is preferably not less than 10 parts by mass and not greater than 70 parts by mass, particularly preferably not less than 20 parts by mass and not greater than 50 parts by mass, based on 100 parts by mass of the base rubber.

If the proportion of the NBR and/or the SBR is less than the aforementioned range, the proportion of the epichlorohydrin rubber is relatively increased. This may excessively reduce the roller resistance of the developing roller, so that the formed image is liable to have an excessively high image density.

If the proportion of the NBR and/or the SBR is greater than the aforementioned range, on the other hand, the proportion of the epichlorohydrin rubber is relatively reduced. This may make it impossible to sufficiently reduce the roller resistance, so that the formed image is liable to have an excessively low image density.

Where a single type of SBR or NBR is used, the proportion of the NBR and/or the SBR is defined as the proportion of the single type of SBR or NBR. Where two or more types of SBRs, two or more types of NBRs or two or more types of SBRs and NBRs are used in combination, the proportion of the NBR and/or the SBR is defined as the total proportion of the two or more types of SBRs and/or NBRs. Where an oil-extension type SBR is used, the proportion of the SBR described above is defined as the solid proportion of the SBR (SBR amount) contained in the oil-extension type SBR.

(CR)

The CR is generally synthesized, for example, by emulsion polymerization of chloroprene, and is classified in a sulfur modification type or a non-sulfur-modification type depending on the type of a molecular weight adjusting agent to be used for the emulsion polymerization.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of these types of CRs may be used. Particularly, CRs of the non-sulfur-modification type and the lower crystallization speed type are preferably used either alone or in combination.

Further, a rubber of a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used either alone or in combination.

The proportion of the CR to be blended is a balance obtained by subtracting the proportions of the NBR and/or the SBR and the epichlorohydrin rubber from the total of the base rubber. The proportion of the CR is determined so that the total amount of the NBR and/or the SBR, the epichlorohydrin rubber and the CR is 100 parts by mass.

<Crosslinking Component>

A crosslinking agent, an accelerating agent and acceleration assisting agent are blended as a crosslinking component in the rubber composition for crosslinking the base rubber.

(Crosslinking Agent)

Examples of the crosslinking agent include a sulfur crosslinking agent, a thiourea crosslinking agent, a triazine derivative crosslinking agent, a peroxide crosslinking agent and monomers, which may be used either alone or in combination.

Examples of the sulfur crosslinking agent include sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is an integer of 1 to 10).

Examples of the peroxide crosslinking agent include benzoyl peroxide and the like.

According to the type of the crosslinking agent and the like, the accelerating agent and the acceleration assisting agent may be blended in predetermined proportions in the rubber composition.

(Accelerating Agent and Acceleration Assisting Agent)

Examples of the accelerating agent include inorganic accelerating agents such as lime, magnesia (MgO) and litharge (PbO), and organic accelerating agents, which may be used either alone or in combination.

Examples of the organic accelerating agents include a guanidine accelerating agent, a thiazole accelerating agent, a sulfenamide accelerating agent, a thiuram accelerating agent and a thiourea accelerating agent, which may be used either alone or in combination. Different types of accelerating agents have different functions and, therefore, two or more different types of accelerating agents are preferably used in combination.

Examples of the guanidine accelerating agent include 1,3-diphenylguanidine (D), 1,3-di-o-tolylguanidine (DT), 1-o-tolylbiguanide (BG) and a di-o-tolylguanidine salt of dicatechol borate, which may be used either alone or in combination. Particularly, 1,3-di-o-tolylguanidine (DT) is preferred.

Examples of the thiazole accelerating agent include 2-mercaptobenzothiazole (M), di-2-benzothiazolyl disulfide (MD), a zinc salt of 2-mercaptobenzothiazole (MZ), a cyclohexylamine salt of 2-mercaptobenzothiazole (HM,M60-CT), 2-(N,N-diethylthiocarbamoylthio)benzothiazole (64) and 2-(4'-morpholinodithio)benzothiazole (DS, MDB), which may be used either alone or in combination. Particularly, di-2-benzothiazolyl disulfide (DM) is preferred.

Examples of the sulfenamide accelerating agent include N-cyclohexyl-2-benzothiazylsulfenamide and the like.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TBT), tetrakis(2-ethylhexyl)thiuram disulfide (TOT-N) and dipentamethylenethiuram tetrasulfide (TRA), which may be used either alone or in combination. Particularly, tetramethylthiuram monosulfide (TS) is preferred.

Examples of the acceleration assisting agent include metal compounds such as zinc white, fatty acids such as stearic acid, oleic acid and cotton seed fatty acids, and other conventionally known acceleration assisting agents, which may be used either alone or in combination.

The proportions of the crosslinking agent, the accelerating agent and the acceleration assisting agent to be blended are properly determined according to the types, the combination and the proportions of the rubbers for the base rubber, or the types and the combination of the crosslinking agent, the accelerating agent and the acceleration assisting agent.

<Electrically Conductive Carbon Black>

The roller body can be imparted with electrical conductivity by blending electrically conductive carbon black in the rubber composition. If the electrically conductive carbon black is blended in an excessively great amount, however, the roller body is liable to have an uneven roller resistance with significant variations. Therefore, the proportion of the electrically conductive carbon black to be blended is preferably not less than 1 part by mass and not greater than 5 parts by mass, particularly preferably nor greater than 3 parts by mass, based on 100 parts by mass of the base rubber.

<Other Ingredients>

As required, an acid accepting agent, a filler and the like may be blended in the rubber composition.

In the presence of the acid accepting agent, chlorine-containing gases generated from the epichlorohydrin rubber during the crosslinking of the base rubber is prevented from remaining in the roller body. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where any of the hydrotalcites is used in combination with magnesium oxide or potassium oxide, a higher acid accepting effect can be provided, thereby more advantageously preventing the contamination of the photoreceptor body.

The proportion of the acid accepting agent to be blended is preferably not less than 0.2 parts by mass and not greater than 10 parts by mass, particularly preferably not less than 1 part by mass and not greater than 5 parts by mass, based on 100 parts by mass of the base rubber.

If the proportion of the acid accepting agent is less than the aforementioned range, it will be impossible to sufficiently provide the aforementioned effect of the blending of the acid accepting agent. If the proportion of the acid accepting agent is greater than the aforementioned range, the roller body is liable to have an increased hardness after the crosslinking.

Examples of the filler include zinc oxide, silica, carbon, carbon black, clay, talc, calcium carbonate, magnesium carbonate, aluminum hydroxide and titanium oxide, which may be used either alone or in combination.

The blending of the filler makes it possible to properly control the rubber hardness of the roller body and to improve the mechanical strength of the roller body.

The proportion of the filler to be blended is preferably not greater than 50 parts by mass, particularly preferably not greater than 10 parts by mass, based on 100 parts by mass of the base rubber.

The rubber composition can be prepared in a conventional manner. First, the rubbers for the base rubber are blended in the predetermined proportions, and the resulting base rubber is simply kneaded. After additives other than the crosslinking component are added to and kneaded with the base rubber, the crosslinking component is finally added to and further kneaded with the resulting mixture. Thus, the rubber composition is provided. A kneader, a Banbury mixer, an extruder or the like, for example, is usable for the kneading.

<Developing Roller>

FIG. 1 is a perspective view illustrating an exemplary developing roller according to one embodiment of the present invention.

Referring to FIG. 1, the developing roller 1 according to this embodiment includes a hollow cylindrical roller body 2 formed from the rubber composition, and a shaft 4 inserted through a center through-hole 3 of the roller body 2.

The roller body 2 may be nonporous or may be porous. In order to prevent the permanent compressive deformation and the wear of the roller body and to improve the durability of the developing roller, it is particularly preferred that the roller body 2 is nonporous substantially without internal cells.

The roller body 2 may have a double layer structure including an outer layer adjacent to an outer peripheral surface 5 thereof, and an inner layer adjacent to the shaft 4. In this case, at least the outer layer may be formed from the rubber composition.

However, the roller body 2 preferably basically has a single layer structure formed from the aforementioned rubber composition as shown in FIG. 1 in order to simplify the construction of the developing roller 1 for production of the developing roller 1 at the highest possible productivity at the lowest possible costs.

The shaft 4 is a unitary member made of a metal such as aluminum, an aluminum alloy or a stainless steel. The roller body 2 and the shaft 4 are electrically connected and mechanically fixed to each other, for example, with an electrically conductive adhesive agent and, therefore, are unitarily rotatable.

The outer peripheral surface 5 of the roller body 2 is preferably polished by a conventional method. Thus, the outer peripheral surface 5 entirely has a generally uniform surface geometry, whereby the toner layer to be formed on the outer peripheral surface 5 in the developing step is prevented from having an uneven thickness due to variations in the surface geometry of the outer peripheral surface. Thus, the toner layer is allowed to have a more uniform thickness.

The outer peripheral surface 5 of the roller body 2 may be formed with an oxide film 6 as indicated on a greater scale in FIG. 1.

The formation of the oxide film 6 makes it possible to finely control the adhesive force of the outer peripheral surface 5 with respect to the toner as described above. Further, the oxide film 6 functions as a dielectric layer to reduce the dielectric dissipation factor of the developing roller 1.

As described above, the oxide film 6 is preferably formed by irradiating the outer peripheral surface 5 of the roller body 2 with the ultraviolet radiation. This method is advantageous because the method ensures easy and efficient formation of the oxide film 6. That is, the formation of the oxide film 6 in the outer peripheral surface 5 is achieved, for example, through oxidation of the rubber composition forming the outer peripheral surface 5 of the roller body 2 by irradiation with ultraviolet radiation having a predetermined wavelength for a predetermined period of time.

Since the rubber composition forming the outer peripheral surface 5 of the roller body 2 per se is oxidized by the irradiation with the ultraviolet radiation to form the oxide film 6, the oxide film 6 is highly uniform in thickness and surface geometry without the problems associated with the coating layer formed by the application of the coating agent in the prior art.

The wavelength of the ultraviolet radiation for the irradiation is preferably not less than 100 nm and not greater than 400 nm, particularly preferably not greater than 300 nm, in order to efficiently oxidize the base rubber for the formation of the oxide film 6. Further, the irradiation period is preferably not shorter than 30 seconds and not longer than 30 minutes, particularly preferably not shorter than 1 minute and not longer than 15 minutes.

The oxide film 6 may be formed by other method, and may be obviated in some case.

The outer peripheral surface 5 of the roller body 2 of the developing roller 1 is preferably configured so as to have an adhesive force of not less than 18 nN and not greater than 40 nN with respect to the toner to be used in combination with the developing roller 1 in an image forming apparatus by blending the tackiness imparting agent in the rubber composition or by forming the oxide film 6 in the outer peripheral surface 5.

Where the adhesive force of the outer peripheral surface 5 with respect to the toner is not less than 18 nN, it is possible to further reduce the variations in toner triboelectric chargeability and toner transporting ability to allow the toner layer to have a further uniform thickness, thereby further suppressing imaging failures such as the fogging phenomenon and the inconsistent image density which may otherwise occur when the toner layer has an uneven thickness.

If the adhesive force is greater than 40 nN, the toner adhering to the outer peripheral surface is not easily transferred from the outer peripheral surface to the surface of the photoreceptor drum, so that the formed image is liable to have a reduced image density. Further, frictional forces occurring between the outer peripheral surface of the roller body and seal members are liable to be increased. Therefore, portions of the outer peripheral surface kept in contact with the seal members are worn by repeated image formation, for example, when about 8000 images are formed. This may result in formation of gaps between the outer peripheral surface and the seal members, thereby causing leakage of the toner.

The adhesive force is more preferably not less than 20 nN and not greater than 35 nN in order to allow the toner layer to have a further uniform thickness while preventing the toner leakage and the reduction in the image density of the formed image as much as possible.

In the present invention, the adhesive force with respect to the toner is expressed as a measurement value that is determined by a measurement method (to be described later) with the use of a centrifugal adhesive force analyzer (MODEL NS-C200 available from Nano Seeds Corporation).

The developing roller 1 can be produced in the conventional manner by employing the rubber composition containing the ingredients described above.

That is, the rubber composition is heated to be melted while being kneaded by means of an extruder. The melted rubber composition is extruded into an elongated hollow cylindrical shape through a die conformal to the sectional shape (annular sectional shape) of the roller body 2.

Then, the extruded rubber composition is cooled to be solidified, and then the resulting product is heated to be vulcanized in a vulcanization can with a temporary vulcanization shaft inserted through a through-hole 3 thereof.

In turn, the resulting product is removed from the temporary shaft, and fitted around a shaft 4 having an outer peripheral surface to which an electrically conductive adhesive agent is applied. Where the adhesive agent is a thermosetting adhesive agent, the thermosetting adhesive agent is thermally cured to electrically connect and mechanically fix the roller body 2 to the shaft 4.

As required, the outer peripheral surface 5 of the roller body 2 is polished to a predetermined surface roughness and then, as required, oxidized by the irradiation with the ultraviolet radiation. Thus, the oxide film 6 is formed as covering the outer peripheral surface 5. In this manner, the developing roller 1 shown in FIG. 1 is produced.

The developing roller is advantageously used in combination with a quantity regulating blade for developing an electrostatic latent image formed on a surface of a photoreceptor drum into a toner image in an electrophotographic image forming apparatus such as a laser printer, an electrostatic copying machine, a plain paper facsimile machine or a printer-copier-facsimile multifunction machine.

EXAMPLES

Example 1

Preparation of Rubber Composition

First, 25 parts by mass of NBR (lower acrylonitrile content NBR JSR N250 SL available from JSR Co., Ltd. and having an acrylonitrile content of 20%), 25 parts by mass of CR (SHOPRENE (registered trade name) WRT available from Showa Denko K.K.) and 50 parts by mass of ECO (EPICHLOMER (registered trade name) D available from Daiso Co., Ltd. and having an ethylene oxide content of 61 mol %) were blended to prepare a base rubber.

While 100 parts by mass of the base rubber was simply kneaded by a Banbury mixer, a rosin ester as a tackiness imparting agent (available under the trade name of SUPER ESTER A-75 from Arakawa Chemical Industries Ltd. and having an acid value of not greater than 10 and a softening point of 70° C. to 80° C. (as measured by the ring and ball method)) and ingredients (shown below in Table 1) except for a crosslinking component were added to and kneaded with the base rubber. Then, the crosslinking component was added to and further kneaded with the resulting mixture. Thus, a rubber composition was prepared.

TABLE 1

| Ingredients | Parts by mass |
|---|---|
| Ethylene thiourea | 1 |
| 5% oil-containing sulfur | 1.5 |
| Accelerating agent DT | 0.85 |
| Accelerating agent DM | 1.5 |
| Accelerating agent TS | 0.5 |
| Zinc white | 5 |
| Electrically conductive carbon black | 2 |
| Hydrotalcites | 3 |

The ingredients shown in Table 1 are as follows:

Ethylene thiourea: Crosslinking agent available under ACCEL (registered trade name) 22-S from Kawaguchi Chemical Industry Co., Ltd.

5% Oil-containing sulfur: Crosslinking agent available from Tsurumi Chemical Industry Co., Ltd.

Accelerating agent DT: 1,3-Di-o-tolylguanidine available under NOCCELER (registered trade name) DT from Ouchi Shinko Chemical Industrial Co., Ltd.

Accelerating agent DM: Di-2-benzothiazolyl disulfide available under NOCCELER DM from Ouchi Shinko Chemical Industrial Co., Ltd.

Accelerating agent TS: Tetramethylthiuram monosulfide available under NOCCELER TS from Ouchi Shinko Chemical Industrial Co., Ltd.

Zinc white: Acceleration assisting agent available under ZINC OXIDE TYPE-2 from Mitsui Mining & Smelting Co., Ltd.

Electrically conductive carbon black: Available under DENKA BLACK (registered trade name) from Denki Kagaku Kogyo K.K.

Hydrotalcites: Acid accepting agent available under DHT-4A (registered trade name) 2 from Kyowa Chemical Industry Co., Ltd.

The amounts (parts by mass) of the ingredients shown in Table 1 are based on 100 parts by mass of the base rubber.

(Production of Developing Roller)

The rubber composition was fed into an extruder and then extruded into a hollow cylindrical body having an outer diameter of 20.0 mm and an inner diameter of 7.0 mm. Then, the cylindrical body was fitted around a temporary crosslinking shaft, and crosslinked at 160° C. for 1 hour in a vulcanization can.

Subsequently, bile cylindrical body was removed from the temporary shaft, then fitted around a shaft having an outer diameter of 7.5 mm and an outer peripheral surface to which an electrically conductive thermosetting adhesive agent was applied, and heated to 160° C. in an oven. Thus, the cylindrical body was fixed to the shaft. Thereafter, opposite end portions of the cylindrical body were trimmed, and the outer peripheral surface of the cylindrical body was polished by a traverse polishing process utilizing a cylindrical polisher and then by a mirror polishing process to be thereby finished as having an outer diameter of 16.00 mm (with a tolerance of 0.05). Thus, a roller body combined with the shaft was produced.

Subsequently, the outer peripheral surface of the polished roller body was rinsed with water, and then the roller body was set in a UV irradiation apparatus (PL21-200 available from Sen Lights Corporation) with its outer peripheral surface spaced 10 cm from a UV lamp. In turn, the roller body was rotated about the shaft by 90 degrees at each time, while being irradiated with ultraviolet radiation at wavelengths of 184.9 nm and 253.7 nm. The irradiation with the ultraviolet radiation was carried out for 5 minutes after each rotation, i.e., for a total period of 20 minutes for the entire outer peripheral surface 5. Thus, an oxide film was formed in the outer peripheral surface. In this manner, a developing roller was produced.

Examples 2 to 4 and Comparative Examples 1 and 2

Rubber compositions were prepared in substantially the same manner as in Example 1, except that the rosin ester was blended as the tackiness imparting agent in proportions of 1 part by mass (Comparative Example 1), 5 parts by mass (Example 2), 10 parts by mass (Example 3), 15 parts by mass (Example 4; and 50 parts by mass (Comparative Example 2) based on 100 parts by mass of the base rubber. Then, developing rollers were produced by using the rubber compositions thus prepared.

Example 5

A rubber composition was prepared in substantially the same manner as in Example 3, except that 10 parts by mass of the NBR, 30 parts by mass of the CR and 60 parts by mass of the ECO were blended for the base rubber. Then, a developing roller was produced by using the rubber composition thus prepared.

Example 6

A rubber composition was prepared in substantially the same manner as in Example 3, except that 50 parts by mass of the NBR, 17 parts by mass of the CR and 33 parts by mass of the ECO were blended for the base rubber. Then, a developing roller was produced by using the rubber composition thus prepared.

Example 7

A rubber composition was prepared in substantially the same manner as in Example 3, except that 70 parts by mass of the NBR, 10 parts by mass of the CR and 20 parts by mass of the ECO were blended for the base rubber. Then, a developing roller was produced by using the rubber composition thus prepared.

Example 8

A rubber composition was prepared in substantially the same manner as in Example 3, except that an SBR (JSR1502 available from JSR Co., Ltd.) was blended instead of the NBR in the same proportion. Then, a developing roller was produced by using the rubber composition thus prepared.

Example 9

A rubber composition was prepared in substantially the same manner as in Example 1, except that 10 parts by mass of a rosin ester available under the trade name of SUPER ESTER A-100 (having an acid value of not greater than 10 and a softening point of 95° C. to 105° C. (as measured by the ring and ball method)) from Arakawa Chemical Industries Ltd. was blended as the tackiness imparting agent. Then, a developing roller was produced by using the rubber composition thus prepared.

Measurement of Toner Adhesive Force

From each of the roller bodies of the developing rollers produced in the examples and the comparative examples, a rectangular test strip having a size of 5 mm×5 mm and having a surface defined by the outer peripheral surface of the roller body was cut out, and bonded onto a metal plate with the outer peripheral surface facing up. Thus, a sample was prepared for measurement of an adhesive force.

Measurement of Adhesive Force

A centrifugal adhesive force analyzer (MODEL NS-C200 available from Nano Seeds Corporation) including an image analyzing section and a centrifuging section was used for the measurement. About 300 particles of a positively-chargeable nonmagnetic single-component toner having a center particle diameter of 6.5 μm were spread on the surface of the sample (the outer peripheral surface of the roller body). This state was defined as an initial state. The amount of the toner particles adhering to the surface of the sample in the initial state (adhering toner particle number) was accurately counted through image analysis in the image analyzing section of the analyzer.

Subsequently, the sample in the initial state was set in a standard holder of the centrifugal adhesive force analyzer, and the holder was set in a rotor of the centrifuging section of the analyzer. The sample was subjected to a centrifuging process at a predetermined rotation speed, and then the amount of toner particles remaining on the surface of the sample (remaining toner particle number) was counted again through the image analysis in the image analyzing section of the analyzer. The centrifuging process was performed at five rotation speeds defining five centrifugal force levels G ($=r\times\omega^2$) of 0, 2000, 8000, 12000 and 16000.

Subsequently, an approximation expression was determined by plotting the rotation angular speeds ω for the five centrifugal force levels G and the remaining toner particle numbers observed at the five centrifugal force levels. Based on the approximation expression, a rotation angular speed ω observed when 50% of the toner particles present on the surface of the sample in the initial state were removed from the surface of the sample and 50% of the toner particles remained on the surface of the sample was determined.

Based on the rotation angular speed ω thus determined, a toner adhesive force $F_{50}$ (nN) of the outer peripheral surface of the roller body of each of the developing rollers of the examples and the comparative examples was calculated from the following expression (1):

$$F_{50}=(\pi/6)\times\rho\times d^3\times r\times\omega^2 \quad (1)$$

In the above expression, ρ is the absolute specific gravity of the toner (=1.1), and d is the average diameter of the toner particles (=6.5 μm). Further, r is the rotation radius of the sample set in the rotor of the centrifuging section during the centrifuging process (=55 mm).

Image Evaluation

The developing rollers produced in the examples and the comparative examples were each incorporated in a laser printer having a printable A4 size sheet number of about 4000 (as determined and disclosed in conformity with the Japanese Industrial Standards JIS X6932:2008). After 4000 plain paper sheets were sequentially printed (at a printing percentage of 1%) at a temperature of 23.5° C. at a relative humidity of 55% with the use of a positively-chargeable nonmagnetic single-component toner by the laser printer, an evaluation image was formed on a paper sheet. Then, the quality of the formed image was evaluated on the following evaluation criteria:

Excellent (○): An image having a proper image density, and free from imaging failures such as the fogging phenomenon and the inconsistent image density. Acceptable (Δ): An image having a lower or higher image density within an acceptable range, or slightly suffering from the imaging failures such as the fogging phenomenon and the inconsistent image density. Unacceptable (x): An image having an excessively low or high image density outside the acceptable range, or significantly suffering from the imaging failures.

The results are shown in Tables 2 and 3.

TABLE 2

| | Comparative Example 1 | Example 1 | Example 2 | Example 3 | Example 4 | Comparative Example 2 |
|---|---|---|---|---|---|---|
| | Base rubber | | | | | |
| ECO | 50 | 50 | 50 | 50 | 50 | 50 |
| CR | 25 | 25 | 25 | 25 | 25 | 25 |

TABLE 2-continued

| | Comparative Example 1 | Example 1 | Example 2 | Example 3 | Example 4 | Comparative Example 2 |
|---|---|---|---|---|---|---|
| NBR | 25 | 25 | 25 | 25 | 25 | 25 |
| SBR | — | — | — | — | — | — |
| Tackiness imparting agent | | | | | | |
| A-75 | 1 | 2.5 | 5 | 10 | 15 | 50 |
| A-100 | — | — | — | — | — | — |
| Evaluation | | | | | | |
| Adhesive force (nN) | 14 | 18 | 24 | 33 | 40 | 50 |
| Image evaluation | x | Δ | ○ | ○ | Δ | x |

TABLE 3

| | Example 5 | Example 6 | Example 7 | Example 8 | Example 9 |
|---|---|---|---|---|---|
| Base rubber | | | | | |
| ECO | 60 | 33 | 20 | 50 | 50 |
| CR | 30 | 17 | 10 | 25 | 25 |
| NBR | 10 | 50 | 70 | — | 25 |
| SBR | — | — | — | 25 | — |
| Tackiness imparting agent | | | | | |
| A-75 | 10 | 10 | 10 | 10 | — |
| A-100 | — | — | — | — | 10 |
| Evaluation | | | | | |
| Adhesive force (nN) | 20 | 29 | 26 | 31 | 32 |
| Image evaluation | Δ | ○ | Δ | ○ | ○ |

The results for Examples 1 to 9 and Comparative Examples 1 and 2 shown in Tables 2 and 3 indicate that, where the tackiness imparting agent is blended in a proportion of not less than 2.5 parts by mass and not greater than 15 parts by mass based on 100 parts by mass of the base rubber, the entire outer peripheral surface of the roller body can be uniformly imparted with a proper adhesive force to reduce the variations in toner triboelectric chargeability and toner transporting ability on the outer peripheral surface as much as possible, whereby the toner layer is formed as having a uniform thickness to suppress imaging failures such as the fogging phenomenon and the inconsistent image density.

Particularly, the results for Examples 1 to 4 indicate that the proportion of the tackiness imparting agent to be blended is preferably not less than 5 parts by mass and not greater than 10 parts by mass based on 100 parts by mass of the base rubber.

Further, the results for Examples 3 and 5 to 8 indicate that, in order to maintain the image density of the formed image within a proper range, the proportion of the NBR and/or the SBR is preferably not less than 10 parts by mass and not greater than 70 parts by mass, particularly preferably not less than 20 parts by mass and not greater than 50 parts by mass, based on 100 parts by mass of the base rubber.

This application corresponds to Japanese Patent Application No. 2012-160796 filed in the Japan Patent Office on Jul. 19, 2012, the disclosures of which are incorporated herein by reference in its entirety.

What is claimed is:

1. A developing roller to be use in an electrophotographic image forming apparatus, the developing roller comprising a roller body formed from a rubber composition, wherein the rubber composition comprises:

a base rubber; and not less than 2.5 parts by mass and not greater than 15 parts by mass of a tackiness imparting agent based on 100 parts by mass of the base rubber, wherein the base rubber is a mixture comprising:

at least one selected from the group consisting of an acrylonitrile butadiene rubber and a styrene butadiene rubber;

a chloroprene rubber; and an epichlorohydrin rubber.

2. The developing roller according to claim 1, wherein the tackiness imparting agent is present in a proportion of not less than 5 parts by mass and not greater than 10 parts by mass based on 100 parts by mass of the base rubber in the rubber composition.

3. The developing roller according to claim 2, wherein the tackiness imparting agent includes a rosin ester.

4. The developing roller according to claim 1, wherein the roller body is formed from the rubber composition in a single layer structure, and has an oxide film formed in an outer peripheral surface thereof by irradiation with ultraviolet radiation having a wavelength of not less than 100 nm and not greater than 400 nm.

5. The developing roller according to claim 1, wherein the outer peripheral surface of the roller body has an adhesive force of not less than 18 nN and not greater than 40 nN with respect to toner for use in the image forming apparatus.

* * * * *